United States Patent [19]

Szymaszek

[11] 4,080,110

[45] Mar. 21, 1978

[54] CONTROL SYSTEM FOR VARIABLE CAPACITY GAS COMPRESSOR

[75] Inventor: Paul G. Szymaszek, Milwaukee, Wis.

[73] Assignee: Vilter Manufacturing Corporation, Milwaukee, Wis.

[21] Appl. No.: 763,659

[22] Filed: Jan. 28, 1977

Related U.S. Application Data

[63] Continuation-in-part of Ser. No. 684,493, May 10, 1976, abandoned.

[51] Int. Cl.[2] ..... F04B 49/02

[52] U.S. Cl. ..... 417/280; 417/282; 417/292; 417/309; 417/310; 418/201

[58] Field of Search ..... 417/280, 282, 292, 309, 417/310, 28, 32; 418/201

[56] References Cited

U.S. PATENT DOCUMENTS

| | | | |
|---|---|---|---|
| 2,400,335 | 5/1946 | Dodson | 417/280 |
| 3,380,650 | 4/1968 | Drummond et al. | 417/280 |
| 3,432,089 | 3/1969 | Schibbye | 417/310 |
| 3,502,026 | 3/1970 | Toyoda | 417/32 |
| 3,924,972 | 12/1975 | Szymaszek | 417/310 |
| 3,961,862 | 6/1976 | Edstrom et al. | 417/292 |

*Primary Examiner*—Carlton R. Croyle

*Assistant Examiner*—Thomas I. Ross

*Attorney, Agent, or Firm*—James E. Nilles

[57] ABSTRACT

A variable capacity rotary screw compressor driven by an electric motor and having an adjustable slide valve for varying compressor capacity is provided with a control system for adjusting the slide valve to regulate compressor capacity and thereby maintain a variable system condition, such as gas inlet or outlet pressure or temperature, within a predetermined range. The control system comprises first means including a current transformer for sensing changes in motor current as compressor capacity varies and a current converter connected to the current transformer for providing a first electrical signal proportional to compressor capacity. The control system also comprises means for sensing changes in the particular system condition being monitored and for providing a second electrical signal proportional thereto. The control system further comprises means including a proportioning relay for receiving and comparing the aforesaid first and second electrical signals and for providing a third signal to control operation of the adjustable slide valve to thereby regulate compressor capacity and maintain the system condition within a predetermined range.

20 Claims, 1 Drawing Figure

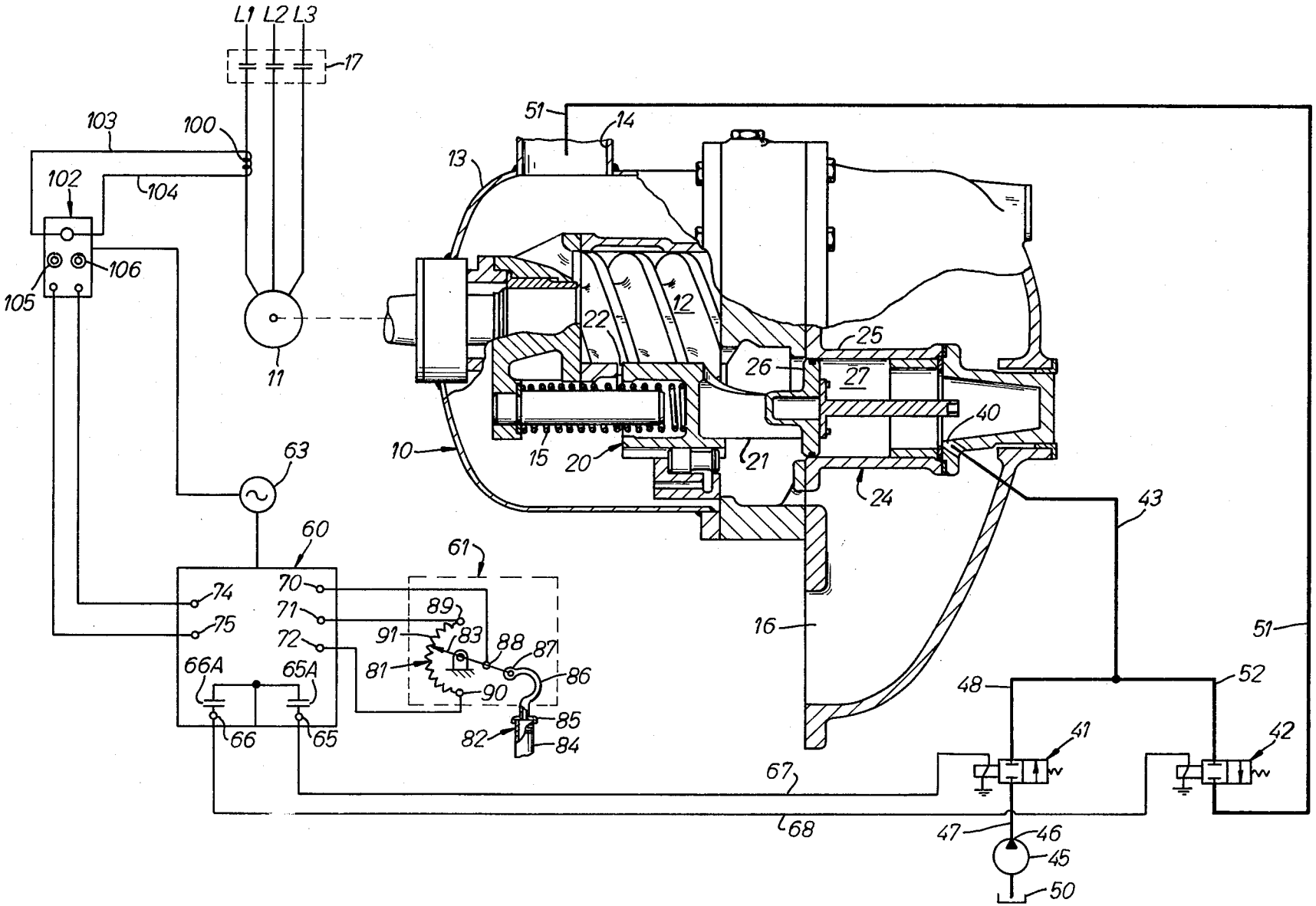
L1 L2 L3
17
100
104
103
102
106
105
11
13
14
51
10
12
22
15
20
21
26
25
27
24
40
43
16
52
42
41
48
47
46
45
50
67
68
61
89
83
91
81
88
87
86
90
85
84
82
63
60
70
71
72
65A
65
66
66A
74
75

CONTROL SYSTEM FOR VARIABLE CAPACITY GAS COMPRESSOR

REFERENCE TO RELATED CO-PENDING APPLICATION

This is a continuation-in-part application from U.S. Ser. No. 684,493, filed May 10, 1976, now abandoned.

BACKGROUND OF THE INVENTION

1. Field of Use

This invention relates generally to a control system for a variable capacity gas compressor. In particular it relates to a control system for operating the adjustable compressor slide valve in response to signals representative of compressor capacity and a variable system condition, such as gas pressure or temperature at the compressor inlet, outlet, or elsewhere in the system, to regulate compressor capacity and thereby maintain the variable system condition within a predetermined range.

2. Description of the Prior Art

My U.S. Pat. No. 3,924,972 issued Dec. 9, 1975 and assigned to the same assignee as the present application is entitled "Control Means For A Variable Capacity Rotary Screw Compressor" and discloses a control system wherein the slide valve is adjusted to regulate compressor capacity and maintain a system condition within a predetermined range. The compressor disclosed in that patent employed a slide valve having a stem which extended outwardly from within the compressor housing and the control system employed electromechanical means connected to the stem for ascertaining slide valve position and for deriving and providing an electrical signal representative of compressor capacity.

SUMMARY OF THE INVENTION

It is desirable to provide compressors of a type wherein the housing is virtually completely sealed against unnecessary gas leakage and to eliminate any outwardly extending slide valve components. However, it is still necessary for control purposes to be able to derive and employ a signal representative of compressor capacity. I have discovered that in a compressor driven by an electric motor there is a relationship between the current flow to the motor and the capacity of the compressor. In particular, as compressor capacity increases, electric current flow to the motor increases because of the heavier load imposed on the compressor and motor.

In accordance with the present invention, there is provided a variable capacity rotary screw compressor which is driven by an electric motor and which is provided with an adjustable slide valve which is operable to vary the capacity of the compressor. The slide valve is operated by a double-acting hydraulic piston which in turn is operable in response to a pair of solenoid valves. A control system is provided to operate the adjustable slide valve to thereby regulate compressor capacity and maintain a variable system condition being monitored, such as gas pressure or gas termperature at the suction inlet or discharge outlet of the compressor, or elsewhere in the system within a predetermined range. The control system comprises first means including a current transformer for sensing changes in electrical current flow to the motor as compressor capacity varies and a current converter connected to the current transformer for providing a first electrical signal proportional to compressor capacity. The control system also comprises means for sensing changes in the particular system condition being monitored and for providing a second electrical signal proportional thereto. The control system further comprises means including a proportioning relay for receiving and comparing the aforesaid first and second electrical signals and for providing a third signal to control operation of the solenoid valves so as to operate the adjustable slide valve to thereby regulate compressor capacity and maintain the system condition being monitored within a predetermined range.

A control system in accordance with the invention offers several advantages. For example, it enables use of a compressor having a sealed housing from which no portion of the slide valve need extend. Furthermore, it eliminates the need to employ a complex and more costly electromechanical slide valve position sensing and signal generating arrangement. Instead, it provides a completely electronic more reliable system which is initially cheaper than a system employing electromechanical components and is easier to service in that it employs easily replaceable electrical or electronic modules. Other objects and advantages will hereinafter appear.

BRIEF DESCRIPTION OF THE DRAWINGS

The single sheet of drawing in this application contains a single figure which depicts a compressor partly in cross section and schematically depicts a control system for the compressor in accordance with the invention.

DESCRIPTION OF A PREFERRED EMBODIMENT

Referring to the single FIGURE of the drawing there is shown a variable capacity rotary screw compressor 10 which is driven by an electric motor 11 and which is provided with an adjustable slide valve 20 which is operable to vary or control the capacity of the compressor.

Electric motor 11 is a conventional three phase motor energizable from a conventional source of three phase electric power comprising the phase lines L1, L2, and L3 by means of a conventional motor controller 17. When motor 11 is energized and is driving compressor 10, variations or changes in the capacity of the compressor produces corresponding variations or changes in the load on the compressor and motor. As a consequence, current flow through phase line L1 (as well as in lines L2 and L3) to the motor 11 will vary or change in proportion to the load on the motor. Thus, the variation in current flow in line L1 is related to or proportional to compressor capacity. Compressor 10 has a pair of helical rotors 12 (only one of which is shown) mounted within a housing 13 for compressing fluid drawn from a low pressure suction fluid inlet 14 and discharging the compressed fluid to a discharge outlet 16. Slide valve 20, including an axially movable slide valve spool 21, is provided in the housing 13 to control the capacity of the compressor 10. Slide valve spool 21 is shown positioned very close to maximum capacity position, i.e., in position wherein port 22 is almost closed. Spool 21 is movable rightward with respect to the FIGURE to a minimum capacity position. A biasing spring 15 is disposed between a fixed portion of housing 13 and slide valve spool 21 and tends to bias the spool rightward toward minimum capacity position.

More specifically, control means are provided to adjust slide valve 20 by effecting axial movement of the slide valve spool 21 to thereby control the capacity of the compressor 10. The control means comprise a hydraulic actuator 24, which cooperates with valve spool biasing spring 15, to adjust the position of slide valve 20 by effecting axial movement of the slide valve spool 21. Actuator 24 is built into housing 13 and comprises a cylinder 25 rigidly secured to the housing and a piston 26 slideably mounted in the cylinder and cooperating therewith to define a hydraulic fluid chamber 27 on one side of the piston. The piston 26 is rigidly connected to or integral with one end of the slide valve spool 21 and both are axially movable together.

A passage 40 communicates with the chamber 27 in the cylinder 25 of actuator 24 and a fluid line 43 connected thereto serves as a means by which hydraulic operating fluid is supplied to or expelled from the chamber 27 to effect movement of piston 26 and corresponding positioning of the slide valve spool 21. The pair of solenoid valves 41 and 42 are provided for controlling hydraulic fluid flow to and from the actuator 24 to control or operate the latter and effect movement or positioning of the slide valve spool 21, i.e., adjustment of slide valve 20.

A pump 45 is provided to supply hydraulic fluid to actuator 24. The pump 45 which may be mounted within compressor housing 13 and driven by compressor 20 from motor 11, is provided to supply hydraulic fluid in the form of oil at high pressure from its pressure port 46 through a line 47, through solenoid valve 41, through a line 48 and through line 43 to the chamber 27 of actuator 24. The solenoid valve 41 operates, when open, to supply fluid from pump 45 to the chamber 27 to cause the actuator piston 26 to move the slide valve spool 21 against the biasing action of spring 15 toward the maximum capacity position (i.e., leftward with respect to the drawing so that port 22 closes). It is to be understood that the pump supplies the hydraulic fluid at a pressure which, for example, exceeds by 40 or 50 p.s.i. the maximum pressure of refrigerant within the compressor. Pump 45 is supplied with oil from a reservoir 50. In practice, pump 45 is also used to supply oil through port 14 of compressor 10 for lubrication of components within the compressor and for other purposes. The suction port 14 of compressor 10 is connected through a line 51, through solenoid valve 42, through a line 52 and through line 43 to the chamber 27 of actuator 24 to permit oil to be expelled from the chamber 27 and drained to suction port 14 when the solenoid valve 42 is open. When solenoid valve 42 is open, slide valve spool 21 and piston 26 are able to move rightward as a unit under the biasing action of spring 15. As spool 21 moves toward its minimum capacity position (i.e., rightward with respect to the drawing) the port 22 opens. It is to be understood that the solenoid valves 41 and 42 are conventional two-way normally closed types which open when their solenoids are energized. A type V-12 solenoid valve manufactured by Skinner Electric Valve Division, New Britain, Connecticut was employed in an actual embodiment of the invention. During system operation either one or both solenoid valves may be closed, but both valves never open simultaneously. It may be assumed for purposes of this disclosure that opening of the solenoid valve 41 increases the compressor capacity and that opening of the solenoid valve 42 decreases the compressor capacity. The solenoid valves 41 and 42 open in response to a voltage applied to the solenoid terminals thereof from a proportioning relay 60 hereinafter described.

A control system is provided to operate the adjustable slide valve 20 to thereby regulate compressor capacity and maintain a variable system condition being monitored, such as gas pressure or gas temperature at the suction inlet or outlet of the compressor, or elsewhere in the system within a predetermined range. The control system comprises first means including a current transformer 100 for sensing changes in electrical current flow to the motor 11 as compressor capacity varies and a current converter 102 connected to the current transformer 100 for providing a first electrical signal proportional to compressor capacity. The control system also comprises means, such as automatic control unit 61, for sensing changes in the particular system condition being monitored and for providing a second electrical signal proportional thereto. The control system further comprises means including a proportioning relay 60 for receiving and comparing the aforesaid first and second electrical signals and for providing a third signal to control operation of the solenoid valves 41 and 42 so as to operate the adjustable slide valve 20 to thereby regulate compressor capacity and maintain the system condition being monitored within a predetermined range.

The current transformer 100 is conventional and is electrically coupled to phase line L1 to motor 11 and is electrically connected by means of electrical conductors 103 and 104 to current converter 102. Current transformer 100 has, for example, an output range of 0 – 5 amperes a.c., depending on the current flow in phase line L1. Current converter 102 may, for example, take the form of a Rochester Instruments Model SC-1300L a.c. Current Transmitter which has an input range of 0 – 5 amperes a.c. and converts the a.c. input signal to a 4 – 20 milliamperes d.c. proportional signal. Current converter 102 is powered from a suitable power source 63. The purpose of current converter or transmitter 102 is to make the current transformer 100 compatible with the proportioning relay 60 hereinafter described in detail. The Model SC-1300L transmitter, which is commercially available from Rochester Instrument Systems, 275 North Union Street, Rochester, New York, 14605, and described in detail in that company's publication designated RIS ET-SC-SM 8/74, has two adjustments. The zero adjustment 105 allows one to have the control to produce an output at an input of between 0–5 amps. The other adjustment 106 is the gain. By adjusting the gain control 106, one can have the output go from 4–20 milliamperes d.c. full scale with an input change of 2 amperes.

The automatic control unit 61 includes a potentiometer 81 adjustable to provide an automatic control signal indicative to the level or range of some system condition being monitored to operate the compressor 10 at a capacity relative to the system condition. The system condition being sensed and controlled could, for example, be suction pressure at port 14 of compressor 10 or pressure at port 16 or temperature in an evaporator associated with the compressor, or the temperature of a fluid coolant, or a similar condition at some point in the system. In the embodiment shown, it may be assumed that system pressure at suction port 14 is being monitored (although pressure at port 16 could be monitored) and the means to accomplish this comprises a pressure sensing and control device 82 which effects movement of the slider 83 of the potentiometer 81 in response to changes or variations in system pressure at port 14. The sensing device 82, which could take any suitable form such as a bourdon tube or bellows, is connected to a fluid sensing supply line 84 which, in turn, is connected to the suction port 14 of compressor 10 but could be located elsewhere in the system. For example, a cap 85 is screwed onto the end of the sensing line 84 and is connected to a curved hollow bourdon tube 86 which terminates in a hollow tube bulb 87. Bulb 87 is mechanically connected to rotatable potentiometer slider 83. As suction pressure changes at port 14, in line 84, in tube 86 and in bulb 87, the bulb moves upwardly or downwardly and transmits such motion to the potentiometer slider 83. The end terminals 89 and 90 of the potentiometer coil 91 and the terminal 88 of the potentiometer slider 83 are connected to the control signal input terminals 70, 71, and 72, respectively, of the relay 60. In an actual embodiment the control unit 61 may take the form of a pressure control including the pressure sensing device 82 and the potentiometer 81. A Penn P80ABA pressure control manufactured by Penn Controls, Inc., Goshen, Indiana was employed in an actual embodiment of the present invention. In such a pressure control the potentiometer slider is positioned in direct relation to the pressure variations which occur and thus produces a variable voltage signal which is indicative of the sensed pressure and the voltage signal is fed to the bridge balancing relay. The Penn P80ABA Pressure Control has a range of 20 inches to 80 psig adjustable. The throttling range of the control is 5.0 #. This means that it takes a change in pressure of 5.0 # to move the wiper arm of the potentiometer from one end to the other producing a 0 to 135 ohm resistance change.

It is to be understood that, instead of pressure at port 14 of compressor 10, another condition such as temperature at some point in the system associated with the compressor could be sensed and responded to in a similar manner as pressure, provided that the potentiometer slider 83 were mechanically connected to and responsive to movement of the condition responsive element. For example, a temperature control suitable for use in the present invention as a substitute for the pressure control may take the form of a Series TB temperature control manufactured by Penn Controls, Inc., Goshen, Indiana. In such a control a sensing element, generally similar to device 82 but of the partial liquid filled type, is employed to position the potentiometer slider 83 in accordance with temperature changes. A temperature increase, for example, causes a portion of the liquid to vaporize which, in turn, produces a positive pressure increase in the sensitive bellows thereby expanding the bellows, and the resultant movement directly positions the potentiometer slider 83.

The relay 60 is an electronic proportioning control used to provide operating power to the solenoid valves in response to control signals supplied thereto. In an actual embodiment of the present invention a Model R7165A proportioning relay manufactured by Honeywell, Apparatus Controls Division, Minneapolis, Minnesota, 55408 was employed. This relay is described in that company's bulletin 95-5921 Rev. 8/71. The relay 60 is supplied with electrical power from a suitable power source 63 and comprises power output terminals 65 and 66 for energizing the increase solenoid valve 41 and for energizing the decrease solenoid valve 42, respectively, through conductors 67 and 68, respectively. In practice, the solenoid coil of each solenoid valve 41, 42 is provided with two terminals and a pair of terminals are provided on relay 60 for connection to each pair of solenoid coil terminals. The relay 60 further comprises three control signal input terminals 70, 71, and 72 connected to unit 61 and two signal input terminals 74 or 75 connected to unit 102. The relay 60 operates to compare the input signals and, if the signals are balanced, to provide no output signal (i.e., no operating signals for the solenoids 41 and 42) at its terminals 65 and 66. However, if there is an imbalance the input signals, either the terminal 65 or the terminal 66 will be energized to operate the increase solenoid valve 41 or the decrease solenoid valve 42, respectively.

The Minneapolis-Honeywell type proportioning control 60 receives two signals. One of the signals at the terminals 70, 71, 72 is a resistance signal of 0–135 ohms from unit 61. The other signal at the terminals 74 and 75 is the 4–20 milliamperes d.c. signal from unit 102. The proportioning control 60 compares the above two signals and actuates one of two relays 65A and 66A which should adjust the 4–20 milliamperes d.c. signal so that it is in proportion to the 0–135 ohm signal. The proportioning signal is capable of three adjustments, for example. The first is set point adjustment whereby one can set the proportioning relay 60 to have a relay output anywhere between 4 and 20 milliamperes d.c. when the resistance is 0. The second adjustment is proportional band adjustment which allows one to adjust the relay output so as to have a relay output in a span narrower than the 4–20 milliamperes span. The third adjustment is dead band adjustment which governs the minimum amount of change in either the 4–20 milliamperes signal, or the resistive signal which will cause an imbalance large enough to call for an output.

The control system in accordance with the invention is operable to effect axial movement of the slide valve spool 21 and thereby control the capacity of the compressor 10. The control system senses or monitors a system condition (such as pressure or temperature) and compressor capacity and responds to departure of the condition from a desired level or range to vary the compressor capacity accordingly to the extent necessary to maintain the desired level or range.

When the compressor is in operation, the control 61 sends a signal to the proportioning relay 60. The proportioning relay 60 compares the magnitude of this signal with that from the current transmitter 102. The level or value of the current transmitter output signal is determined by the electric current flow in line L1 to motor 11. If the current transmitter 102 is sending too small a signal, the proportioning relay 60 actuates the proper solenoid valve 41 or 42 to institute a change of compressor capacity in the increasing direction. If the current transmitter 102 is sending too large a signal, the proportioning relay 60 changes the compressor capacity in the decreasing direction. The adjustment to compressor capacity results in a change of main drive motor current which in turn changes the output of the current transmitter 102 in such a way as to bring the system condition signal and the current transmitter signal back into balance.

During operation, adjustment of the automatic control potentiometer 81 in response to a change in the level or range of the system condition being sensed by sensing unit 82 (i.e., pressure in the embodiment shown) provides a control signal to the relay 60 wherein it is compared to signal information being received from unit 102. The relay 60 sensing the resistance change taking place in the pressure sensing unit 82 endeavors to balance this resistance change and thus provides an output signal for operating the appropriate solenoid valve 41 or 42. The relay 60 will, by energizing the proper solenoid valve 41 or 42, operate the actuator 24 to effect movement of the slide valve spool 21 to a new position wherein compressor capacity is at a level necessary to maintain the system condition at the desired level or range. The relay 60 will keep the appropriate solenoid valve 41 or 42 energized until such time as the signals from automatic control potentiometer 81 and the unit 102 are balanced. When the signals are balanced, there is no output signal from the relay 60 and the solenoid valves 41 and 42 are closed.

I claim:

1. In combination:

a variable capacity compressor tending to exhibit changes in a system condition through and beyond a predetermined range at some point in the system, an adjustable valve connected to said compressor and operable to vary the capacity of said compressor, operating means for operating said adjustable valve, an electric motor for driving said compressor tending to exhibit a change in an electrical condition therein when compressor capacity varies, first means for sensing a change in said electrical condition and for providing a first signal related to compressor capacity, second means for sensing a change in said system condition and for providing a second signal related to said system condition, third means for receiving and comparing said first and second signals and for providing a third signal effecting operation of said operating means to thereby regulate compressor capacity and maintain said system condition within said predetermined range.

2. A combination according to claim 1 wherein said system condition is gas pressure.

3. A combination according to claim 1 wherein said system condition is gas temperature.

4. A combination according to claim 1 wherein said electrical condition is electric current flow in said motor.

5. In combination:

a variable capacity compressor tending to exhibit changes in a system condition through and beyond a predetermined range at some point in the system, an adjustable valve connected to said compressor and operable to vary the capacity of said compressor, operating means for operating said adjustable valve, an electric motor for driving said compressor tending to exhibit a change in electrical current flow therein when compressor capacity varies, first means including a current transformer for sensing a change in said electrical current flow and for providing a first electrical signal related to compressor capacity, second means including a potentiometer for sensing a change in said system condition and for providing a second electrical signal related to said system condition, third means including a proportional relay for receiving and comparing said first and second electrical signals and for providing a third electrical signal effecting operation of said operating means to thereby regulate compressor capacity and maintain said system condition within said predetermined range.

6. A combination according to claim 5 wherein said system condition is gas pressure.

7. A combination according to claim 5 wherein said system condition is gas temperature.

8. In combination:

a variable capacity compressor having a housing and tending to exhibit changes in a system condition through and beyond a predetermined range at some point in the system, an adjustable slide valve connected to said compressor within said housing and operable to vary the capacity of said compressor, operating means including a double-acting hydraulic actuator connected to said actuator and a pair of solenoid valves for said actuator for operating said adjustable slide valve, an electric motor for driving said compressor tending to exhibit a change in electrical current flow therein when compressor capacity varies, a source of electric power for said motor, first means including a current transformer coupled between said source and said motor for sensing a change in said electrical current flow and including a current converter connected to said current transformer for providing a first electrical signal related to compressor capacity, second means including a potentiometer for sensing a change in said system condition and for providing a second electrical signal related to said system condition, third means including a proportioning relay for receiving and comparing said first and second electrical signals and for providing a third electrical signal effecting operation of said solenoids of said operating means to operate said actuator to move said slide valve to thereby regulate compressor capacity and maintain said system condition within said predetermined range.

9. A combination according to claim 8 wherein said system condition is gas pressure.

10. A combination according to claim 8 wherein said system condition is gas temperature.

11. In combination:

a variable capacity compressor tending to exhibit changes in a system condition through and beyond a predetermined range at its suction inlet, an adjustable valve connected to said compressor and operable to vary the capacity of said compressor, operating means for operating said adjustable valve, an electric motor for driving said compressor tending to exhibit a change in an electrical condition therein when compressor capacity varies, first means for sensing a change in said electrical condition and for providing a first signal related to compressor capacity, second means for sensing a change in said system condition and for providing a second signal related to said system condition, third means for receiving and comparing said first and second signals and for providing a third signal effecting operation of said operating means to thereby regulate compressor capacity and maintain said system condition within said predetermined range.

12. A combination according to claim 11 wherein said system condition is gas pressure to the suction of said compressor.

13. A combination according to claim 11 wherein said system condition is gas temperature to the suction inlet of said compressor.

14. A combination according to claim 11 wherein said electrical condition is electric current flow in said motor.

15. In combination:

a variable capacity compressor tending to exhibit changes in a system condition through and beyond a predetermined range at its suction inlet, an adjustable valve connected to said compressor and operable to vary the capacity of said compressor, operating means for operating said adjustable valve, an electric motor for driving said compressor tending to exhibit a change in electrical current flow therein when compressor capacity varies, first means including a current transformer for sensing a change in said electrical current flow and for providing a first electrical signal related to compressor capacity, second means including a potentiometer for sensing a change in said system condition and for providing a second electrical signal related to said system condition, third means including a proportional relay for receiving and comparing said first and second electrical signals and for providing a third electrical signal effecting operation of said operating means to thereby regulate compressor capacity and maintain said system condition within said predetermined range.

16. A combination according to claim 15 wherein said system condition is gas pressure to the suction of said compressor.

17. A combination according to claim 15 wherein said system condition is gas temperature to the suction inlet of said compressor.

18. In combination:

a variable capacity compressor having a housing and tending to exhibit changes in a system condition through and beyond a predetermined range at its suction inlet, an adjustable slide valve connected to said compressor within said housing and operable to vary the capacity of said compressor, operating means including a double-acting hydraulic actuator connected to said actuator and a pair of solenoid valves for said actuator for operating said adjustable slide valve, an electric motor for driving said compressor tending to exhibit a change in electrical current flow therein when compressor capacity varies, a source of electric power for said motor, first means including a current transformer coupled between said source and said motor for sensing a change in said electrical current flow and including a current converter connected to said current transformer for providing a first electrical signal related to compressor capacity, second means including a potentiometer for sensing a change in said system condition and for providing a second electrical signal related to said system condition, third means including a proportioning relay for receiving and comparing said first and second electrical signals and for providing a third electrical signal effecting operation of said solenoids of said operating means to operate said actuator to move said slide valve to thereby regulate compressor capacity and maintain said system condition within said predetermined range.

19. A combination according to claim 18 wherein said system condition is gas pressure to the suction of said compressor.

20. A combination according to claim 18 wherein said system condition is gas temperature to the suction inlet of said compressor.

* * * * *